US007682169B2

(12) United States Patent
Park

(10) Patent No.: US 7,682,169 B2
(45) Date of Patent: Mar. 23, 2010

(54) BIDIRECTIONAL USB PORT FOR VEHICLE

(75) Inventor: Sung Jun Park, Seodaemun-gu (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/326,357

(22) Filed: Dec. 2, 2008

(65) Prior Publication Data

US 2009/0156055 A1 Jun. 18, 2009

(30) Foreign Application Priority Data

Dec. 17, 2007 (KR) ..... 10-2007-0132842

(51) Int. Cl.
*H01R 13/62* (2006.01)

(52) U.S. Cl. ..... 439/159; 439/218

(58) Field of Classification Search ..... 439/159, 439/218, 630, 660
See application file for complete search history.

(56) References Cited

U.S. PATENT DOCUMENTS 5,010,426 A * 4/1991 Krenz ..... 360/97.01
5,286,214 A * 2/1994 Takahashi ..... 439/159
5,490,791 A * 2/1996 Yamada et al. ..... 439/159
5,587,854 A * 12/1996 Sato et al. ..... 360/97.01
6,045,377 A * 4/2000 Kajiura ..... 439/159
6,643,125 B2 * 11/2003 Nabetani et al. ..... 361/679.32
6,981,887 B1 * 1/2006 Mese et al. ..... 439/244
7,052,287 B1 * 5/2006 Ni et al. ..... 439/76.1
7,359,208 B2 * 4/2008 Ni ..... 361/752
7,363,947 B2 * 4/2008 Teicher ..... 139/173

FOREIGN PATENT DOCUMENTS

JP 2003-217728 A 7/2003
WO WO-2006/061231 A1 6/2006

* cited by examiner

*Primary Examiner*—Thanh-Tam T Le
(74) *Attorney, Agent, or Firm*—Edwards Angell Palmer & Dodge LLP; Peter F. Corless

(57) ABSTRACT

Disclosed herein is a bidirectional USB port for a vehicle. In order to allow a USB memory stick to be inserted into a USB port in either direction, two PCBs are provided in the USB port and are arranged in opposite directions such that the USB memory stick can be bidirectionally inserted into the USB port.

5 Claims, 5 Drawing Sheets

BIDIRECTIONAL USB PORT FOR VEHICLE

CROSS-REFERENCE TO RELATED APPLICATIONS

This application claims under 35 U.S.C. §119(a) priority to Korean Application No. 10-2007-0132842, filed on Dec. 17, 2007, the disclosure of which is incorporated herein by reference in its entirety.

BACKGROUND OF THE INVENTION

1. Field of the Invention

The present invention relates to a bidirectional USB (universal serial bus) port for a vehicle, and, more particularly, to a bidirectional USB port for a vehicle, which allows a USB memory stick to be inserted therein in either direction.

2. Background Art

In general, for example as shown in FIG. 1, a vehicle is provided with a USB port 1 for connecting a USB memory stick as an external storage device and a media unit with each other. The USB port 1 serves as an interface for transmitting the data stored in the USB memory stick to the media unit. The media unit receives the data stored in the USB memory stick via the USB port 1 and reproduces the data.

The conventional USB port 1 is preferably constructed to allow the connector of the USB memory stick to be inserted therein only in one fixed direction.

Therefore, when a driver inserts the USB memory stick into the USB port 1 while driving, it may be the case from time to time that the USB memory stick is incorrectly oriented with respect to the USB port 1.

Thus, in order to ensure proper insertion of the USB memory stick into the USB port 1, the driver must check the orientation of the USB port 1 and the USB memory stick and then appropriately insert the USB memory stick into the USB port 1. Accordingly, in the process of ensuring proper insertion, an accident, for example an accident in which the vehicle collides with obstacles or another vehicle, may occur owing to inattentive driving.

The above information disclosed in this the Background section is only for enhancement of understanding of the background of the invention and therefore it may contain information that does not form the prior art that is already known in this country to a person of ordinary skill in the art.

SUMMARY OF THE INVENTION

In one aspect, the present invention provides a bidirectional USB port for a vehicle, which preferably prevents a driver from incorrectly inserting a USB memory stick while driving, preferably making it unnecessary for the driver to reinsert the USB memory stick by turning it upside down, thereby suitably ensuring safe driving and increasing the value of the USB port.

In one preferred embodiment of the present invention, there is preferably provided a bidirectional USB port for a vehicle, wherein, in order to allow a USB memory stick to be suitably inserted into a USB port in either direction, two PCBs are preferably provided in the USB port and are suitably arranged in opposite directions such that the USB memory stick can preferably be bidirectionally inserted into the USB port.

According to another preferred embodiment of the present invention, the USB port comprises a first rack gear having an engagement projection and capable of suitably rotating about a rotation shaft; a guide rail for allowing the rotation shaft of the first rack gear to be suitably inserted therein such that the first rack gear can preferably be moved along a predetermined path while gradually rotating; a second rack gear suitably mounted to the PCB and having a stopper projection which is formed higher than teeth of the second rack gear; a pinion interposed between the first rack gear and the second rack gear and suitably rotatably mounted in a slot to be movable upward and downward, such that the pinion can move the first rack gear as the pinion is rotated by the second rack gear and can be suitably moved upward and downward by the stopper projection to thereby move the first rack gear upward and downward; an engagement groove defined in the PCB such that the engagement projection of the first rack gear can be engaged therein; and a spring preferably disposed behind the PCB such that the PCB can be suitably returned to its initial position by the spring.

According to another preferred embodiment of the present invention, the USB port further comprises a holding member which has a distal end protruding circularly to suitably maintain the USB memory stick in an inserted state.

According to still another preferred embodiment of the present invention, a spring is preferably installed on the rotation shaft to suitably return the first rack gear to an initial position before it rotates.

According to yet another preferred embodiment of the present invention, the rotation shaft of the first rack gear is preferably moved along the guide groove of the guide rail.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and other advantages of the present invention will be more clearly understood from the following detailed description taken in conjunction with the accompanying drawings, which are given hereinafter by way of illustration only, and thus are not limitative of the present invention, and wherein.

DESCRIPTION

Figure 1:
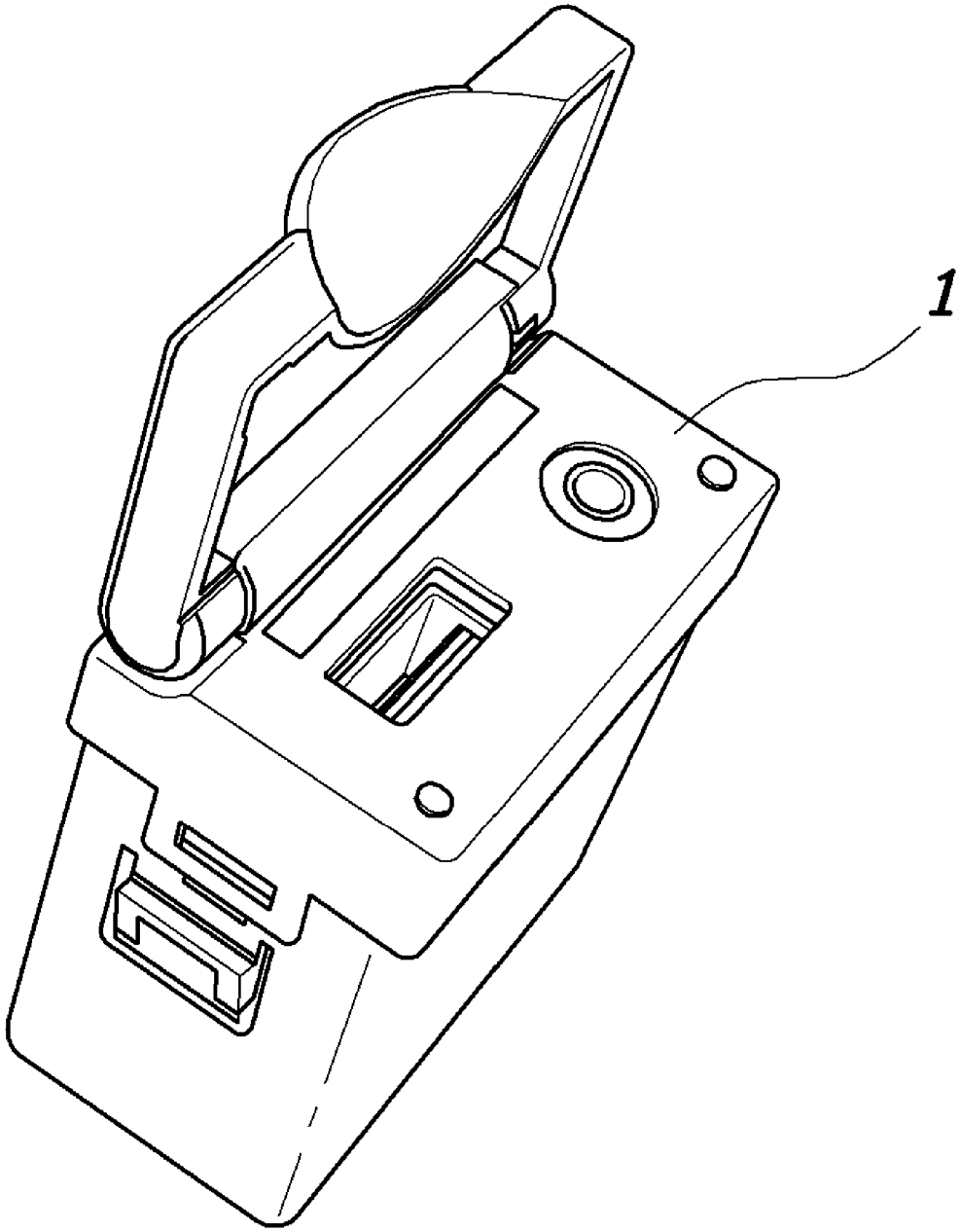
FIG. 1 is a perspective view illustrating a conventional USB port for a vehicle.

In one aspect, the invention features a bidirectional USB port for a vehicle, wherein, in order to allow a USB memory stick to be inserted into a USB port in either direction, two PCBs are provided in the USB port, such that a USB memory stick can be inserted into a USB port in either direction.

In one embodiment, the two PCBs are provided in the USB port are arranged in opposite directions such that the USB memory stick can be bidirectionally inserted into the USB port.

In another embodiment, the USB port comprises a first rack gear, a guide rail, a second rack gear, a pinion interposed between the first rack gear and the second rack gear, an engagement groove, and a spring.

In another embodiment, the first rack gear further comprises an engagement projection and is capable of rotating about a rotation shaft.

In yet another embodiment of the invention as described herein, the guide rail allows the rotation shaft of the first rack gear to be inserted therein such that the first rack gear can be moved along a predetermined path while gradually rotating.

In another further embodiment, the second rack gear is mounted to the PCB and has a stopper projection which is formed higher than teeth of the second rack gear.

In a related embodiment, the pinion interposed between the first rack gear and the second rack gear is rotatably mounted in a slot to be moved upward and downward, such that the pinion can move the first rack gear as the pinion is rotated by the second rack gear and can be moved upward and downward by the stopper projection to thereby move the first rack gear upward and downward.

In another related embodiment, the engagement groove is defined in the PCB such that the engagement projection of the first rack gear is engaged therein.

In still another related embodiment, the spring is disposed behind the PCB such that the PCB can be returned to its initial position by the spring.

The invention also features a motor vehicle comprising the bidirectional USB port as described in any one of the aforementioned aspects.

Reference will now be made in greater detail to preferred embodiments of the invention, examples of which are illustrated in the accompanying drawings. Wherever possible, the same reference numerals will be used throughout the drawings and the description to refer to the same or like parts.

Figure 2:
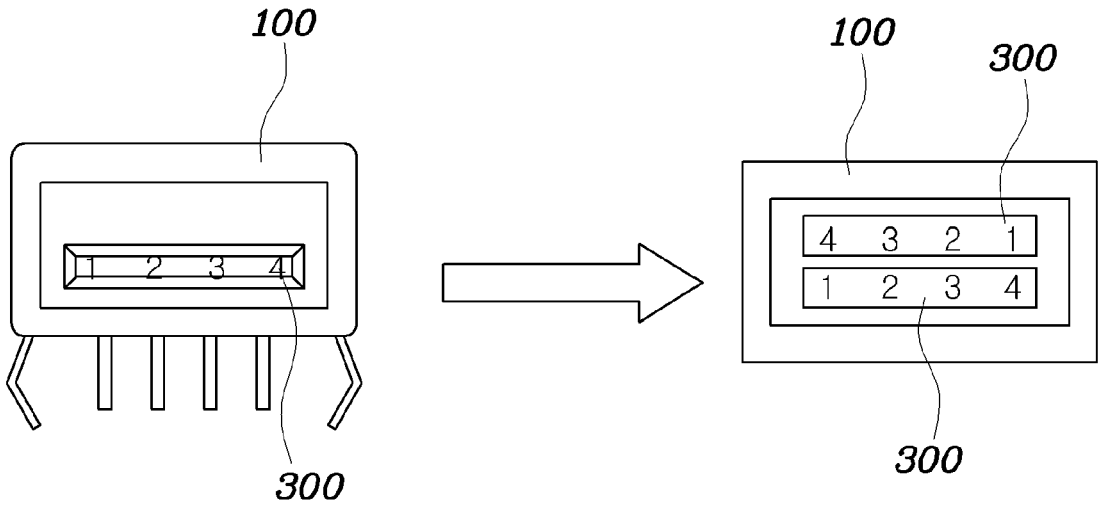
FIG. 2 is a front view illustrating a bidirectional USB port for a vehicle in accordance with an embodiment of the present invention.
Figure 3:
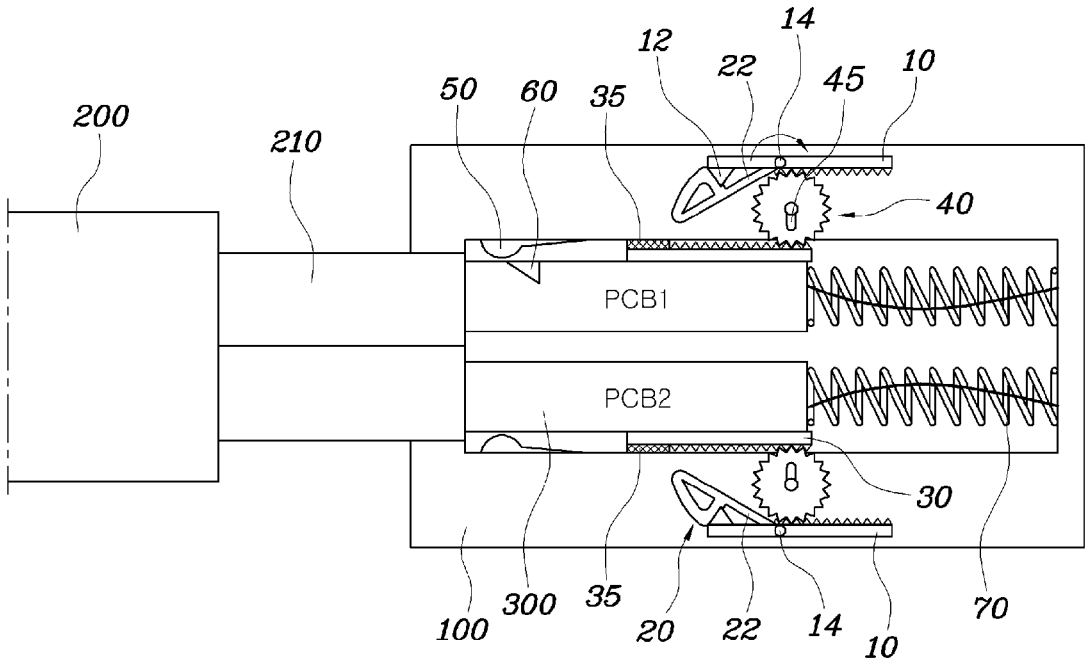
FIG. 3 is a transverse sectional view illustrating the detailed construction of the bidirectional USB port for a vehicle according to the embodiment of the present invention.
Figure 4:
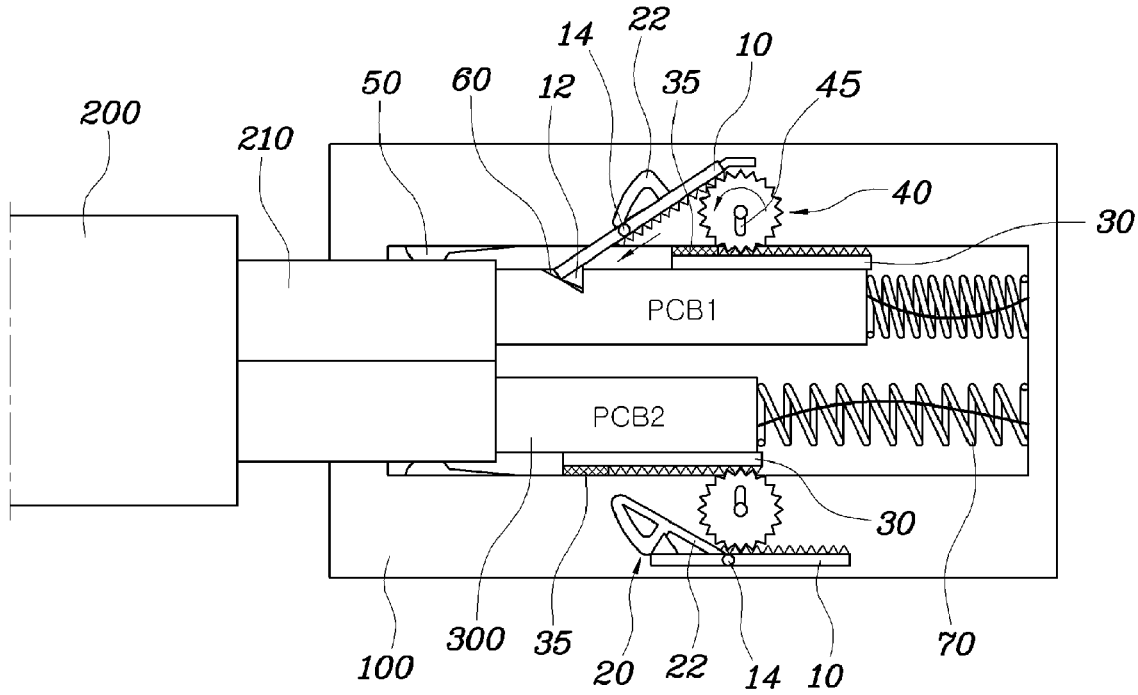
FIG. 4 is a transverse sectional view illustrating the state in which a USB memory stick is inserted into the bidirectional USB port for a vehicle according to the embodiment of the present invention.
Figure 5:
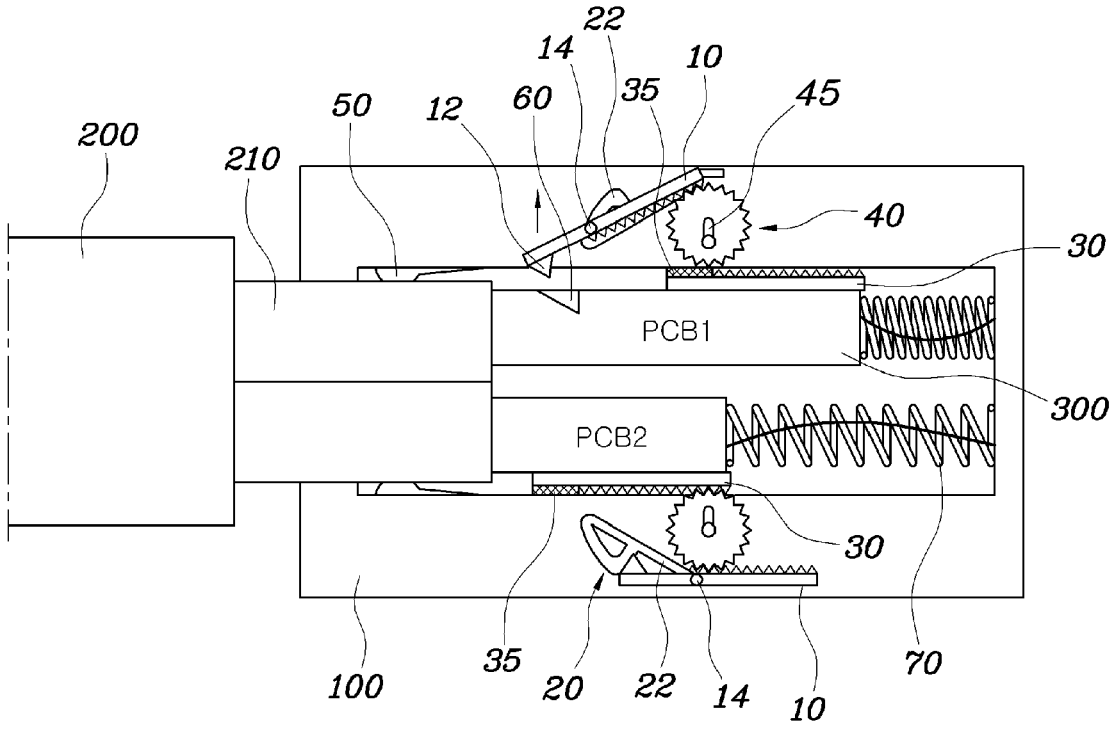
FIG. 5 is a transverse sectional view illustrating the state in which the USB memory stick is removed from the bidirectional USB port for a vehicle according to the embodiment of the present invention.

FIG. 2 is an exemplary front view illustrating a bidirectional USB port for a vehicle in accordance with a preferred embodiment of the present invention. FIG. 3 is an exemplary transverse sectional view illustrating the detailed construction of the bidirectional USB port for a vehicle according to certain preferred embodiments of the present invention. FIG. 4 is an exemplary transverse sectional view illustrating a preferred state in which a USB memory stick is suitably inserted into the bidirectional USB port for a vehicle according to other preferred embodiments of the present invention. FIG. 5 is an exemplary transverse sectional view illustrating a preferred state in which the USB memory stick is suitably removed from the bidirectional USB port for a vehicle according to certain preferred embodiments of the present invention.

According to exemplary embodiments of the invention, referring to FIGS. 2 and 3, a bidirectional USB port 100 for a vehicle in accordance with a preferred embodiment of the present invention is preferably constructed in a manner such that a USB memory stick 200 can be suitably inserted therein in either direction. Preferably, in certain preferred embodiments of the invention, the USB port 100 has two printed circuit boards (PCBs) 300 such that the USB PCB 210 of the USB memory stick 200 can be bidirectionally inserted into the USB port 100. These PCBs 300 are suitably arranged in opposite directions.

In further preferred embodiments, in order to ensure that the USB port 100 has the two PCBs 300 arranged in suitably opposite directions, the following component elements must be suitably provided for each of the two PCBs 300 so that the two PCBs 300 can preferably operate in suitably the same manner.

Accordingly, in the USB port 100, for example as exemplified in FIGS. 3 through 5, a first rack gear 10, a guide rail 20, a second rack gear 30, a pinion 40, a holding member 50, an engagement groove 60 and a spring 70 are preferably provided for each of the two PCBs 300.

In further embodiments, preferably, the first rack gear 10 has an engagement projection 12 on one end thereof and is suitably configured such that it can rotate about the rotation shaft 14 formed adjacent to the middle thereof. Preferably, according to other certain embodiments, the rotation shaft 14 is formed in the shape of a projection which suitably protrudes from the side surface of the first rack gear 10, such that the rotation shaft 14 can be suitably inserted into and moved along the guide rail 20.

In further embodiments, the rotation shaft 14 of the first rack gear 10 is moved along the guide groove 22 suitably defined in the guide rail 20 when the USB memory stick 200 is preferably inserted into the USB port 100. In further preferred embodiments, since the guide groove 22 is suitably defined to incline at a predetermined angle, when the first rack gear 10 is suitably moved by the rotating force of the pinion 40, the first rack gear 10 is rotated toward the PCB 300. Accordingly, in further embodiments, the engagement projection 12 preferably formed on one end of the first rack gear 10 is suitably engaged in the engagement groove 60 of the PCB 300.

The invention features in certain exemplary embodiments a spring that can be suitably installed on the rotation shaft 14 to preferably return the first rack gear 10 to its initial position before it is rotated. According to further embodiments, the spring may preferably comprise a torsional coil spring, although not limited to such, and is suitably installed on the rotation shaft 14, and preferably returns the first rack gear 10 to its initial position after it is suitably moved along the guide rail 20 while rotating.

In other preferred embodiments of the invention, the guide rail 20 suitably performs the function of a guide which guides the movement of the rotation shaft 14 of the first rack gear 10 therealong when the USB memory stick 200 is suitably inserted into and removed from the USB port 100.

In this preferred embodiment of the present invention, the guide rail 20 is suitably defined in the form of the guide groove 22 such that the rotation shaft 14, protruding from the side surface of the first rack gear 10, can be suitably inserted into and moved along the guide groove 22. Accordingly, in further embodiments, throughout the first half of the range of motion of the first rack gear 10, the guide groove 22 is suitably defined to be inclined toward the PCB 300 such that, when the rotation shaft 14 is moved along the guide groove 22, the engagement projection 12 of the first rack gear 10 can be suitably rotated and engaged into the guide groove 60 in the PCB 300. According to other embodiments, throughout the other half of the range of motion of the first rack gear 10, the guide groove 22 is suitably defined to be inclined away from the PCB 300 and to be placed higher than the aforementioned portion of the guide groove 22 such that the engagement projection of the first rack gear 10 can be suitably disengaged from the engagement groove 60 of the PCB 300.

Accordingly, in preferred embodiments, the second rack gear 30 is integrally mounted to the PCB 300 and is preferably meshed with the pinion 40. In further embodiments, when the USB memory stick 200 is preferably inserted into the USB port 100 and thereby the PCB 300 is pushed rearward, the second rack gear 30 is suitably moved integrally with the PCB 300 and rotates the pinion 40.

In other exemplary embodiments of the invention as described herein, a stopper projection 35 is suitably formed on one end of the second rack gear 30 to stop the rotation of the pinion 40. It is preferred, in certain embodiments, that the stopper projection 35 be formed to suitably project higher than the teeth of the second rack gear 30.

According to further preferred embodiments of the invention, the pinion 40 is suitably interposed between and meshed with the first rack gear 10 and the second rack gear 30. Preferably, the pinion 40 is rotatably mounted in a slot 45 such that it can be suitably moved upward and downward. In other embodiments, the pinion 40 is preferably configured such that, when the pinion 40 is rotated by the second rack gear 30, the pinion 40 moves the first rack gear 10 outward, and when the pinion 40 is suitably raised and lowered by the stopper projection 35, the pinion 40 suitably moves the first rack gear 10 upward and downward.

In further preferred embodiments of the invention as described herein, the holding member 50 is suitably disposed inside the USB port 100. Preferably, since the distal end of the holding member 50 circularly protrudes, the holding member 50 maintains the inserted state of the PCB 210 of the USB memory stick 200 when the USB memory stick 200 is inserted into the USB port 100.

Preferably, the engagement groove 60 is defined on one side surface of the PCB 300. Accordingly, as the PCB 300 is pushed inward and the pinion 40 is suitably rotated by the second rack gear 30, when the first rack gear 10 is rotated thereby, the engagement projection 12 is engaged into the engagement groove 60 to fixedly hold the PCB 300.

Preferably, the spring 70 is suitably disposed behind the PCB 300. The spring 70 is suitably compressed as the PCB 300 is pushed inward by the insertion of the USB memory stick 200. According to preferred embodiments, in this state, if the USB memory stick 200 is suitably removed from the USB port 100, the spring 70 preferably returns the PCB 300 to its initial position.

Hereafter, the operation of the bidirectional USB port for a vehicle according to certain preferred embodiments of the present invention, as described herein, will be described with reference to FIGS. 4 and 5.

FIG. 4 schematically illustrates an exemplary method of suitably inserting the USB memory stick 200 into the USB port 100.

In one preferred embodiment, when the USB memory stick 200 is suitably inserted into the USB port 100, as the PCB 210 of the USB memory stick 200 and the PCB 300 of the USB port 100 are brought into contact with each other, the PCB 300 of the USB port 100 is suitably pushed inward.

In another embodiment, as the PCB 300 of the USB port 100 is suitably pushed inward, the second rack gear 30 rotates the pinion 40. Accordingly, by the rotation of the pinion 40, the first rack gear 10 is suitably moved outward along the guide groove 22 of the guide rail 20 while gradually rotating around the rotation shaft 14.

When the rotation of the first rack gear 10 is suitably completed, the engagement projection 12 thereof is engaged into the engagement groove 60 of the PCB 300.

Accordingly, in further embodiments, the reference point where the insertion of the USB memory stick 200 is completed is when the engagement projection 12 of the first rack gear 10 is suitably engaged into the engagement groove 60 of the PCB 300 and the movement of the pinion 40 is stopped by the stopper projection 35 of the second rack gear 30.

Preferably, in certain embodiments, when the engagement is suitably felt during the insertion of the USB memory stick 200, the mounting of the USB memory stick 200 is completed. In further embodiments, the PCB 210 of the USB memory stick 200 and the PCB 300 of the USB port 100 preferably communicate with each other while in suitably contact with each other.

FIG. 5 schematically illustrates an exemplary method of removing the USB memory stick 200 from the USB port 100 according to certain preferred embodiments of the invention.

In other embodiments of the invention, in order to remove the USB memory stick 200 from the USB port 100, the USB memory stick 200 is suitably pushed further inward into the USB port 100. Preferably, by doing this, the pinion 40 suitably rides on the stopper projection 35 of the second rack gear 30. Preferably, as the pinion 40 rides on the stopper projection 35, the first rack gear 10 is moved upward along the guide groove 22 of the guide rail 20. Preferably, as the engagement of the engagement projection 12 into the engagement groove 60 is suitably released, the PCB 300 is returned to its initial position by the elastic force of the spring 70.

In further preferred embodiments, the first rack gear 10 is also returned to its initial (horizontal) position before it is rotated by the spring (not shown) installed on the rotation shaft 14.

In certain preferred embodiments, in examples where the USB memory stick 200 is preferably inserted in the opposite direction, the first rack gear 10, the second rack gear 30, the pinion 40, and so forth, provided to the opposite PCB 300, operate in suitably the same manner. Accordingly, bidirectional insertion of the USB memory stick 200 is possible.

The bidirectional USB port for a vehicle according to the present invention as described herein, can be used by a driver to insert a USB memory stick into a USB port while driving, and according to embodiments of the invention as described herein, as it is not necessary to check the orientation of the USB memory stick relative to the USB port, safe driving can be suitably ensured. Accordingly, as described in the aforementioned embodiments of the invention, as the value of the bidirectional USB port is suitably increased, the driver's satisfaction can be suitably elevated.

Although preferred embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A bidirectional Universal Serial Bus (USB) port for a vehicle, wherein, in order to allow a USB memory stick to be inserted into the USB port in either direction, two Printed circuit Boards (PCBs) are provided in the USB port and are arranged in opposite directions such that the USB memory stick can be bidirectionally inserted into the USB port, the USB port comprising:

a first rack gear having an engagement rotation and being capable of rotating about a rotation shaft;

a guide rail for allowing the rotation shaft of the first rack gear to be inserted therein such that the first rack gear can be moved along a predetermined path while gradually rotating;

a second rack gear mounted to each of the two PCBs and having a stopper projection which is formed higher than teeth of the second rack gear;

a pinion interposed between the first rack gear and the second rack gear and rotatably mounted in a slot to be moved upward and downward, such that the pinion can move the first rack gear as the pinion is rotated by the second rack gear and can be moved upward and downward by the stopper projection to thereby move the first rack gear upward and downward;

an engagement groove defined in the each of the two PCBs such that the engagement projection of the first rack gear is engaged therein; and a spring disposed behind the each of the two PCBs such that the each of the two PCBs; can be returned to an initial position of the each of the two PCBs; by the spring.

2. The bidirectional USB port according to claim 1, wherein the USB port further comprises a holding member which has a distal end protruding circularly to maintain the USB memory stick in an inserted state.

3. A bidirectional Universal Serial Bus (USB) port for a vehicle, wherein, in order to allow a USB memory stick to be inserted into the USB port in either direction, two Printed circuit Boards (PCBs) are provided in the USB port and are arranged in opposite directions such that the USB memory stick can be bidirectionally inserted into the USB port, the USB port comprising;

a first rack gear having an engagement projection and being capable of rotating about a rotation shaft;

a guide rail for allowing the rotation shaft of the first rack gear to be inserted therein such that the first rack gear can be moved along a predetermined path while gradually rotating;

a second rack gear;

a pinion interposed between the first rack gear and the second rack gear;

an engagement groove defined in each of the two PCBs such that the engagement projection of the first rack gear is engaged therein; and a spring disposed behind the each of the two PCBs such that the each of the two PCBs; can be returned to an initial position of the each of the two PCBs; by the spring.

4. The bidirectional USB port according to claim 3, wherein the second rack gear is mounted to the each of the two PCBs and has a stopper projection which is formed higher than teeth of the second rack gear.

5. The bidirectional USB port according to claim 4, wherein the pinion is rotatably mounted in a slot to be moved upward and downward, such that the pinion can move the first rack gear as the pinion is rotated by the second rack gear and can be moved upward and downward by the stopper projection to thereby move the first rack gear upward and downward.

* * * * *